US008976070B2

(12) United States Patent
Kang et al.

(10) Patent No.: US 8,976,070 B2
(45) Date of Patent: Mar. 10, 2015

(54) BROADCASTING ANTENNA FOR VEHICLE AND SHARK FIN ANTENNA APPARATUS HAVING THE SAME

(75) Inventors: Gi-Cho Kang, Anyang-si (KR); Tae-Byung Park, Anyang-si (KR); Sang-Min Nam, Seoul (KR); Chang-Keun Lee, Ansan-si (KR)

(73) Assignee: Winnercom Co., Ltd., Gimhae (KR)

( * ) Notice: Subject to any disclaimer, the term of this patent is extended or adjusted under 35 U.S.C. 154(b) by 420 days.

(21) Appl. No.: 13/494,220

(22) Filed: Jun. 12, 2012

(65) Prior Publication Data

US 2012/0326935 A1 Dec. 27, 2012

(30) Foreign Application Priority Data

Jun. 23, 2011 (KR) ..... 10-2011-0060938

(51) Int. Cl.

| | |
|---|---|
| ***H01Q 1/32*** | (2006.01) |
| ***H01Q 1/38*** | (2006.01) |
| ***H01Q 9/36*** | (2006.01) |
| ***H01Q 9/04*** | (2006.01) |
| ***H01Q 11/08*** | (2006.01) |
| ***H01Q 21/30*** | (2006.01) |
| ***H01Q 5/01*** | (2006.01) |

(52) U.S. Cl.

CPC ..... *H01Q 11/08* (2013.01); *H01Q 1/3275* (2013.01); *H01Q 9/36* (2013.01)

USPC ..... 343/713; 343/700 MS; 343/722; 343/725; 343/828; 343/895

(58) Field of Classification Search

CPC ..... H01Q 1/36; H01Q 1/362; H01Q 1/38; H01Q 5/00; H01Q 9/36; H01Q 21/30; H01Q 1/3275; H01Q 5/0072; H01Q 21/24; H01Q 21/28

USPC ..... 343/713, 725, 752, 846, 700 MS, 722, 343/828, 895

See application file for complete search history.

(56) References Cited

U.S. PATENT DOCUMENTS 4,564,843 A * 1/1986 Cooper ..... 343/745
4,656,483 A * 4/1987 Jaquet ..... 343/745

* cited by examiner

*Primary Examiner* — Michael C Wimer
(74) *Attorney, Agent, or Firm* — LRK Patent Law Firm

(57) ABSTRACT

A broadcasting antenna for a vehicle and a shark fin antenna apparatus having the same are provided. The broadcasting antenna includes a main board on which a feeder circuit and a ground plane are formed, a helical radiation unit which includes a plurality of helical radiators that are electrically connected to the feeder circuit and the ground plane of the main board, that are formed in a first direction, and that are coupled apart from each other by a predetermined interval, and which has a coupling feed structure, and an extended radiation unit which includes a plurality of top loaders that are electrically connected to ends of the plurality of helical radiators, respectively, that are formed in a second direction, and that are coupled to each other.

12 Claims, 23 Drawing Sheets

| Freq. | EFF.[%] | Avg.[dBi] | Peak[dBi] | θ [deg] | ϕ [deg] |
|---|---|---|---|---|---|
| 859MHz | 52.55 | -2.79 | 4.05 | 55.00 | 265.00 |

| Freq. | EFF.[%] | Avg.[dBi] | Peak[dBi] | θ[deg] | φ[deg] |
|---|---|---|---|---|---|
| 859MHz | 75.50 | -1.22 | 4.48 | 55.00 | 265.00 |

Theta-Cut

1920 MHz

Phi-Cut

Gain [dBi]

| Freq. | EFF.[%] | Avg.[dBi] | Peak[dBi] | θ [deg] | ϕ [deg] |
|---|---|---|---|---|---|
| 1920MHz | 56.66 | -2.47 | 5.71 | 65.00 | 95.00 |

Theta-Cut

1920 MHz

Gain [dBi]

Phi-Cut

| Freq. | EFF.[%] | Avg.[dBi] | Peak[dBi] | θ[deg] | ϕ[deg] |
|---|---|---|---|---|---|
| 1920MHz | 57.11 | -2.43 | 5.83 | 65.00 | 110.00 |

| Freq. | EFF.[%] | Avg.[dBi] | Peak[dBi] | θ [deg] | ϕ [deg] |
|---|---|---|---|---|---|
| 2345MHz | 57.27 | -2.42 | 4.76 | 65.00 | 245.00 |

| Freq. | EFF.[%] | Avg.[dBi] | Peak[dBi] | θ [deg] | φ [deg] |
|---|---|---|---|---|---|
| 2345MHz | 64.74 | -1.89 | 4.68 | 65.00 | 45.00 |

BROADCASTING ANTENNA FOR VEHICLE AND SHARK FIN ANTENNA APPARATUS HAVING THE SAME

BACKGROUND OF THE INVENTION

1. Field of the Invention

The present invention relates, in general, to a broadcasting antenna for a vehicle and a shark fin antenna apparatus having the same, and more particularly to a broadcasting antenna for a vehicle and a shark fin antenna apparatus having the same, which includes a helical radiation unit made up of a plurality of helical radiators and having a coupling feed structure and an extended radiation unit made up of a plurality of top loaders, each of which includes a band stop filtering unit and conductive patterns, thereby improving radiation efficiency and preventing signal interference.

2. Description of the Related Art

With the development of wireless communication technology, a variety of wireless communication antennas are mounted on vehicles. In the case of a typical broadcasting antenna for a vehicle which operates at an FM/AM broadcasting frequency band, use is made of a monopole, type of retractable antenna whose length is adjusted to an operating frequency by a motor and which is mainly installed on the outside of the vehicle. However, this retractable antenna not only causes damage to an appearance of the vehicle, but also increases noise due to air resistance while traveling.

Further, to overcome these problems, a glass antenna, which is mainly installed around a defroster of a vehicle rear window, has an advantage in that it provides a smart appearance to the vehicle and no noise while traveling, but it has a disadvantage in that the manufacturing cost of the vehicle increases due to a royalty. The glass antenna operates like a slot antenna due to a fixed size of the rear window. As such, in the case of a vehicle whose rear window has a size that is unfit for resonance of a broadcasting frequency band, a helical micro-antenna having a length of 200 mm is used as the broadcasting antenna in place of the glass antenna.

However, this micro-antenna is installed outside the vehicle, causes damage to an appearance of the vehicle, and generates noise such as wind noise while traveling due to a protruding height, like the retractable antenna. To overcome these problems, the length of the micro-antenna may be reduced. In this case, radiation efficiency is reduced.

For this reason, attention has recently been paid to a shark fin antenna apparatus for a vehicle capable of providing a good design in appearance, avoiding an increase in manufacturing cost due to a royalty, and mounting a plurality of antennas at the same time. Furthermore, attention has also been paid to an attempt to mount the broadcasting antenna in the shark fin antenna apparatus.

However, when the broadcasting antenna is mounted in the shark fin antenna apparatus, a disc having a ground plane of a 1 meter size is used. In this case, due to a restricted space in which a height of the antenna should be within 70 mm, the broadcasting antenna is formed as a small electrical antenna whose size is smaller than $\lambda/16$ of the operating frequency. This small electrical antenna has a problem in that, as its size is reduced, its radiation efficiency is sharply reduced. As such, to obtain desired radiation efficiency within the restricted space, the total physical length of an antenna radiator is increased. In this case, the operating frequency shifted to a relatively low frequency band, so that it is difficult to meet requirements of a specific frequency band, and the appearance of the vehicle is also damaged. Further, since the plurality of antennas operating at different frequency bands coexist within the restricted space, characteristics of the additionally mounted broadcasting antenna and characteristics of the previously mounted antennas are simultaneously deteriorated due to signal inference.

Thus, there is an urgent need for technology that relatively improves the radiation efficiency within the restricted space in the shark fin antenna apparatus on which the plurality of antennas and the broadcasting antenna are mounted together, prevents the signal interference, and actually provides high applicability.

SUMMARY OF THE INVENTION

Accordingly, the present invention has been made keeping in mind the above problems occurring in the related art, and an object of the present invention is to provide a broadcasting antenna for a vehicle and a shark fin antenna apparatus having the same, in which a helical radiation unit is made up of a plurality of helical radiators and has a coupling feed structure, and in which an extended radiation unit is made up of the plurality of top loaders, which are electrically connected to the ends of the plurality of helical radiators, and each of which includes at least one band stop filtering unit and a plurality of conductive patterns between which the band stop filtering unit is disposed. Thereby, the broadcasting antenna and the shark fin antenna apparatus can be made small within a restricted space, operate at a specific frequency band in spite of an increase in length, improve the radiation efficiency, and prevent the signal interference.

In order to achieve the above object, according to an aspect of the present invention, there is provided a broadcasting antenna for a vehicle, which includes a main board on which a feeder circuit and a ground plane are formed. The broadcasting antenna includes: a helical radiation unit which includes a plurality of helical radiators that are electrically connected to the feeder circuit and the ground plane of the main board, that are formed in a first direction, and that are coupled apart from each other by a predetermined interval, and which has a coupling feed structure; and an extended radiation unit which includes a plurality of top loaders that are electrically connected to ends of the plurality of helical radiators respectively, that are formed in a second direction, and that are coupled to each other. The plurality of top loaders each includes at least one band stop filtering unit and a plurality of conductive patterns between which the at least one band stop filtering unit is disposed.

According to another aspect of the present invention, there is provided a shark fin antenna apparatus having a broadcasting antenna for a vehicle, which includes a main board on which a feeder circuit and a ground plane are formed and which is formed on the main board. The shark fin antenna apparatus includes: a broadcasting antenna that includes: a helical radiation unit which includes a plurality of helical radiators that are electrically connected to the feeder circuit and the ground plane of the main board, that are formed in a first direction, and that are coupled apart from each other by a predetermined interval, and which has a coupling feed structure; and an extended radiation unit which includes a plurality of top loaders that are electrically connected to ends of the plurality of helical radiators respectively, that are formed in a second direction, and that are coupled to each other, the plurality of top loaders each including at least one band stop filtering unit and a plurality of conductive patterns between the band stop filtering unit is disposed; a mobile communication antenna that is formed in an upward direction of the main board, and is formed in a P shape on one side of a dielectric board, on opposite upper surfaces of which the plurality of top loaders constituting the extended radiation unit of the broadcasting antenna are partly disposed; and a circularly polarized ceramic patch antenna that includes a patch antenna at a predetermined position on the main board on which the broadcasting antenna and the mobile communication antenna are located, and an extended ground that is formed of a metal conductor having the same shape as the patch antenna and is electrically connected with the ground plane.

As described above, the present invention provides the broadcasting antenna in which a helical radiation unit is made up of the plurality of helical radiators and has the coupling feed structure, and an extended radiation unit is made up of the plurality of top loaders, which are electrically connected to the ends of the plurality of helical radiators and each of which includes at least one band stop filtering unit and a plurality of conductive patterns between which the band stop filtering unit is disposed. Thereby, the broadcasting antenna can be made small within a restricted space, operate at a specific frequency band in spite of an increase in length, improve the radiation efficiency, and prevent the signal interference.

Further, the present invention provides the shark fin antenna apparatus in which: the broadcasting antenna includes the helical radiation unit having the coupling feed structure, and the extended radiation unit made up of the plurality of top loaders that are electrically connected to the ends of the plurality of helical radiators and each include at least one band stop filtering unit and a plurality of conductive patterns between which the band stop filtering unit is disposed, and that can be made small within a restricted space, operate at a specific frequency band in spite of an increase in length, improve the radiation efficiency, and prevent the signal interference; the mobile communication antenna includes the second band stop filtering unit removing the interference signals and the conductive patterns between which the second band stop filtering unit is disposed, and that improves the radiation efficiency; and the circularly polarized ceramic patch antenna includes the extended ground which is formed under a patch antenna, which has a predetermined thickness, which is formed of a metal conductor having the same shape as the patch antenna unit, and which is electrically connected to a ground plane formed on a main board, and whose thickness can be adjusted to control the radiation efficiency at a specific frequency band.

BRIEF DESCRIPTION OF THE DRAWINGS

The above and other objectives, features, and advantages of the present invention will be more clearly understood from the following detailed description when taken in conjunction with the accompanying drawings, in which.

DETAILED DESCRIPTION OF THE INVENTION

A broadcasting antenna for a vehicle and a shark fin antenna apparatus having the same for carrying out the present invention start from the assumption that a feeder circuit and a main board 1 having a ground plane are provided.

Reference will now be made in greater detail to exemplary embodiments of the invention with reference to the accompanying drawings.

Figure 1:
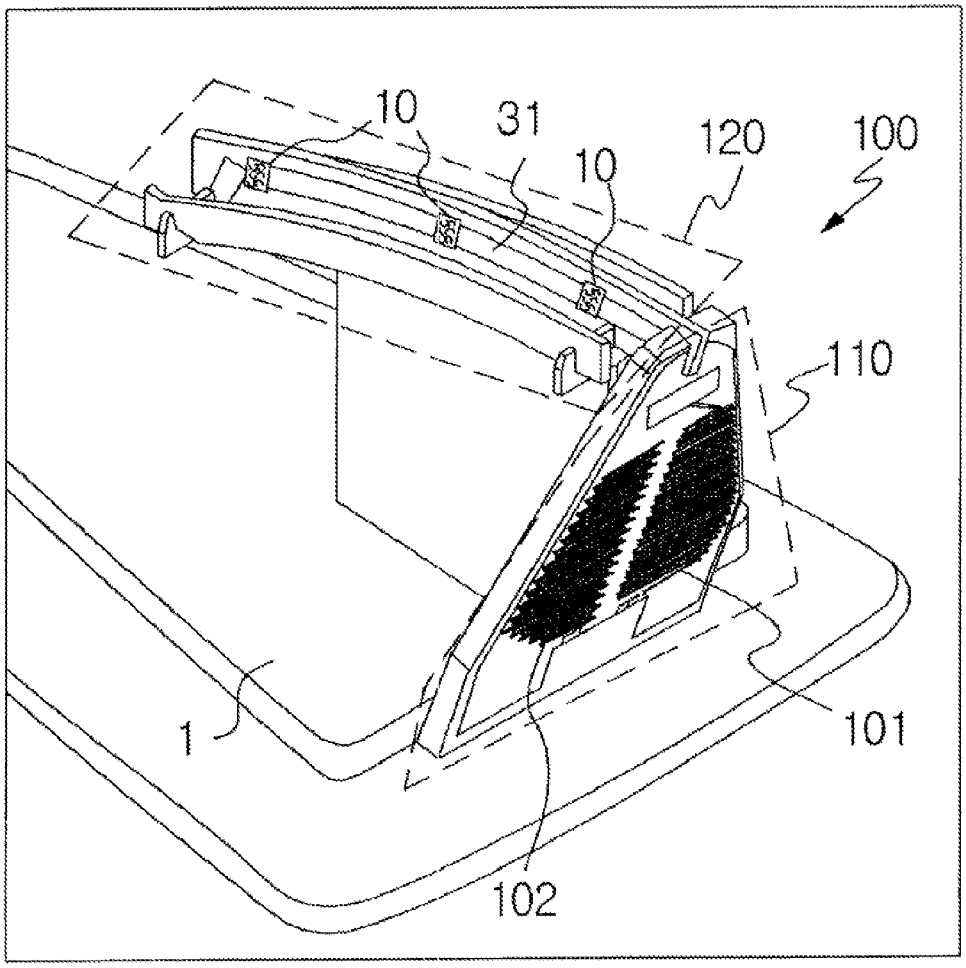
FIG. 1 is a schematic view showing a configuration of a broadcasting antenna for a vehicle according to an embodiment of the present invention.

FIG. 1 is a schematic view showing a configuration of a broadcasting antenna for a vehicle according to an embodiment of the present invention.

As shown in FIG. 1, the broadcasting antenna 100 for a vehicle according to an embodiment of the present invention improves radiation efficiency and prevents signal interference, and includes a helical radiation unit 110 having a plurality of helical radiators 101 and 102, and an extended radiation unit 120 having a plurality of top loaders 121 and 122.

In detail, the helical radiators 101 and 102 of the helical radiation unit 110 are electrically connected to a feeder circuit and a ground plane of a main board 1, are formed in an upward direction (first direction) of the main board 1, and are coupled apart from each other. Thereby, the helical radiation unit 110 has a coupling feed structure. The top loaders 121 and 122 of the extended radiation unit 120 are electrically connected to ends of the helical radiators 101 and 102, are formed in a lengthwise direction (second direction) of the main board 1, and are coupled to each other.

Here, the helical radiators 101 and 102 are inclined at a predetermined angle in an outward upward direction of the main board 1 to reduce electromagnetic interference from the ground plane of the main board 1. An angle between the direction (first direction) in which the helical radiators 101 and 102 of the helical radiation unit 110 are formed and the direction (second direction) in which the top loaders 121 and 122 of the extended radiation unit 120 are formed is an acute angle. In the embodiment of the present invention, to prevent the helical radiation unit 110 having the plurality of helical radiators 101 and 102 from deviating from a restricted space, a dielectric board 103 on which the helical radiation unit 110 is formed is preferably inclined with respect to the main board 1 at a predetermined angle in the outward upward direction of the main board 1.

Further, each of the top loaders 121 and 122 of the extended radiation unit 120 includes at least one band stop filtering unit 10 and a plurality of conductive patterns 31 between which the band stop filtering unit 10 is disposed.

Here, the at least one band stop filtering unit 10 includes at least one band stop filter 11 to remove interference signals operating at different frequency bands from that of a signal by which the broadcasting antenna 100 according to the embodiment is operated, and impedance matching elements 12 corresponding to the ends of the helical radiators 101 and 102 to which the top loaders 121 and 122 of the extended radiation unit 120 are electrically connected.

Further, to prevent the conductive patterns 31 from serving as antenna radiators, the conductive patterns 31 constituting each of the top loaders 121 and 122 are each formed at a shorter length than $\lambda/8$ of an operating frequency within a relatively highest one of frequency bands at which the interference signals other than the signal by which the broadcasting antenna is operated operates.

Figure 2:
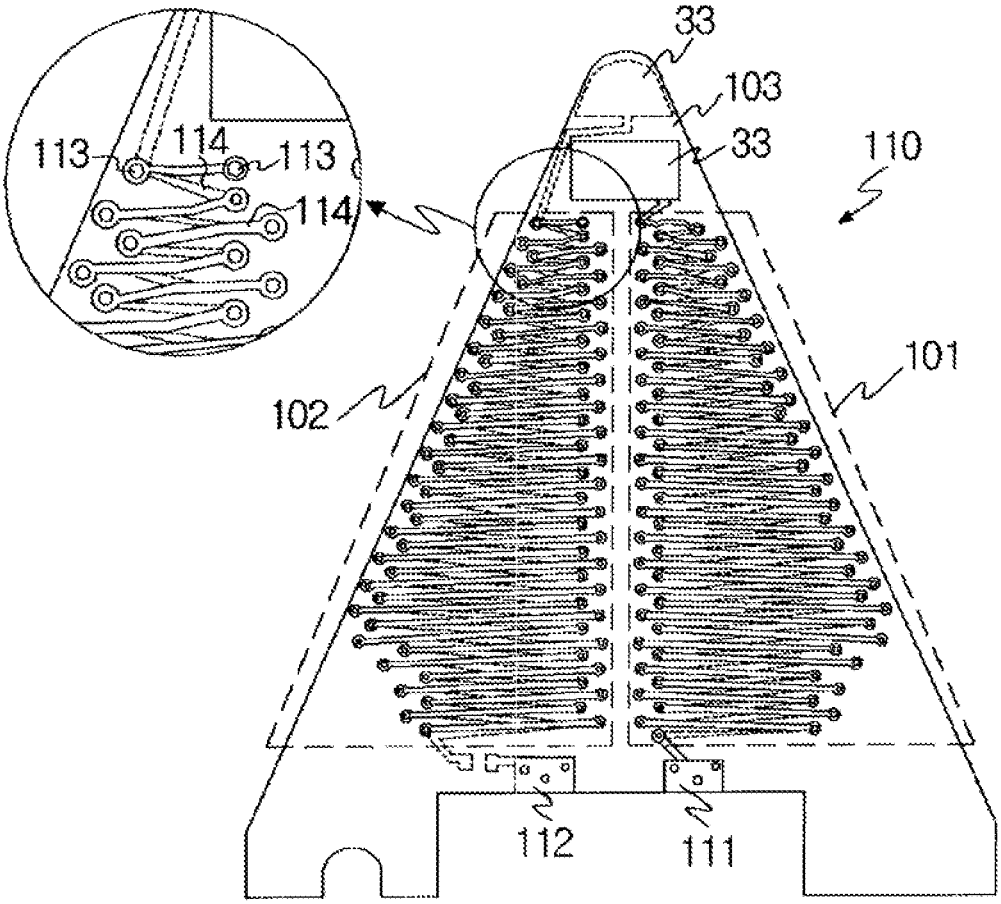
FIG. 2 shows a configuration of the helical radiation unit of the broadcasting antenna according to the embodiment of the present invention.

FIG. 2 shows a configuration of the helical radiation unit of the broadcasting antenna according to the embodiment of the present invention.

As shown in FIG. 2, the helical radiation unit 110 includes a first helical radiator 101 having a feeder 111 electrically connected to the feeder circuit of the main board 1, a second helical radiator 102 having a ground 112 electrically connected to the ground plane of the main board 1, and a main dielectric board 103 in which the first helical radiator 101 and the second helical radiator 102 are spaced apart from each other by a predetermined interval.

Here, each of the first and second helical radiators 101 and 102 includes through-holes 113 passing through the main dielectric board 103 and conductive line patterns 114 formed on opposite surfaces of the main dielectric board 103 so as to have a helical structure.

The helical radiation unit of FIG. 2 will be described in comparison with a normal mode helical antenna with reference to FIGS. 3A to 3D.

First, it is assumed that the helical radiation unit of FIG. 2 according to the embodiment operates at an FM broadcasting frequency band from 88 MHz to 108 MHz.

Figure 3A:
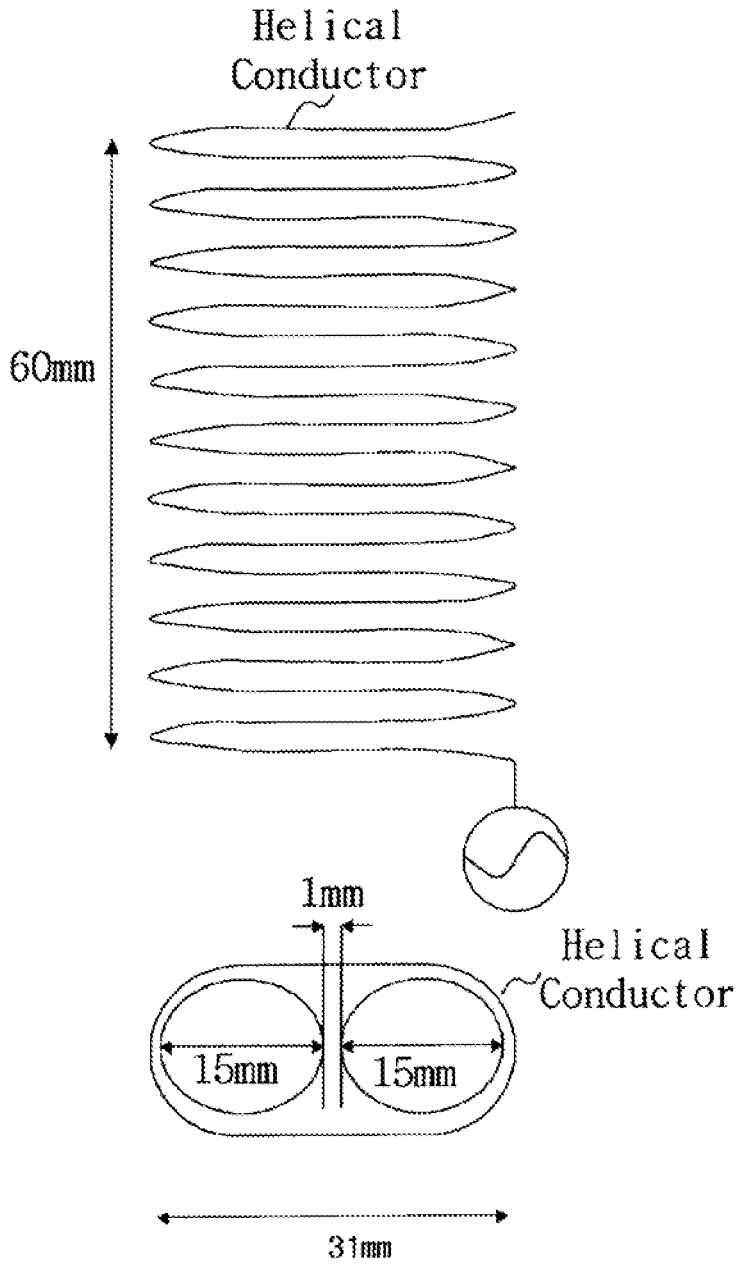
FIG. 3A is a schematic view showing a configuration of a normal mode helical antenna that resonates at 98 MHz.

FIG. 3A is a schematic view showing a configuration of a normal mode helical antenna that resonates at 98 MHz.

As shown in FIG. 3A, it is assumed that the normal mode helical antenna resonates at 98 MHz that is a central frequency of the FM broadcasting frequency band, and that a single helical conductor to which a feed signal is applied continues to be formed on two cylinders that have a diameter of 15 mm and a height of 60 mm and are disposed at an interval of 1 mm.

Figure 3B:
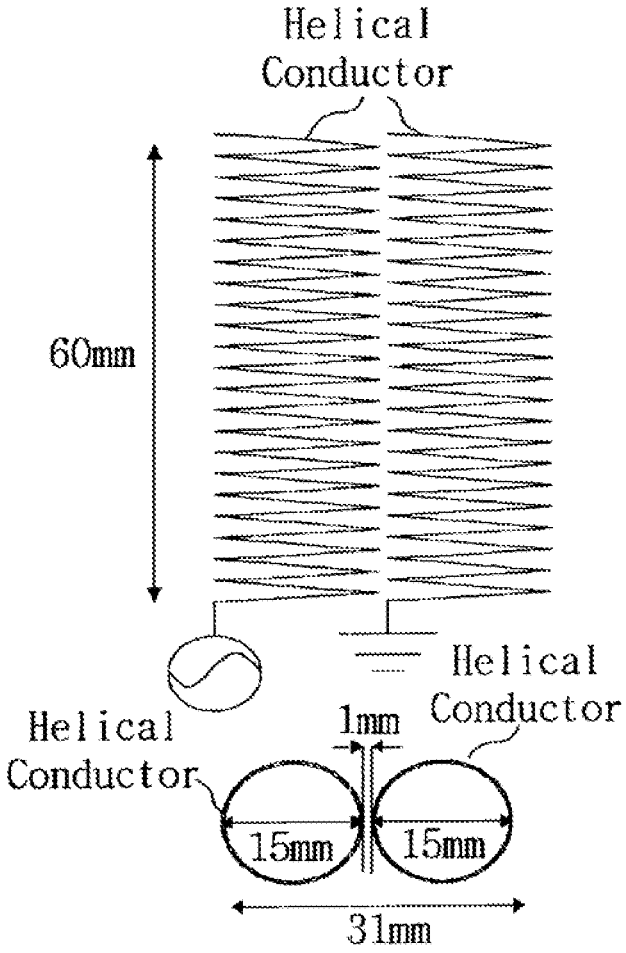
FIG. 3B is a schematic view showing a configuration of a helical antenna that has a coupling feed structure as in the embodiment of the present invention and is designed so as to correspond to FIG. 3A.

FIG. 3B is a schematic view showing a configuration of a helical antenna that has a coupling feed structure as in the embodiment of the present invention, and is designed so as to correspond to FIG. 3A.

The helical antenna having an indirect coupling feed structure corresponding to FIG. 3A is configured so that a plurality of helical conductors are electrically connected to the feeder circuit and the ground plane, respectively, and are formed on two respective cylinders which have a diameter of 15 mm and a height of 60 mm and are disposed at an interval of 1 mm so as to occupy the same space as the space for the normal mode helical antenna of FIG. 3A. Further, a length of the two helical conductors is designed to resonate at 74 MHz that is lower than the central frequency of the FM broadcasting frequency band when the helical conductor connected to the ground plane is not present.

Figure 3C:
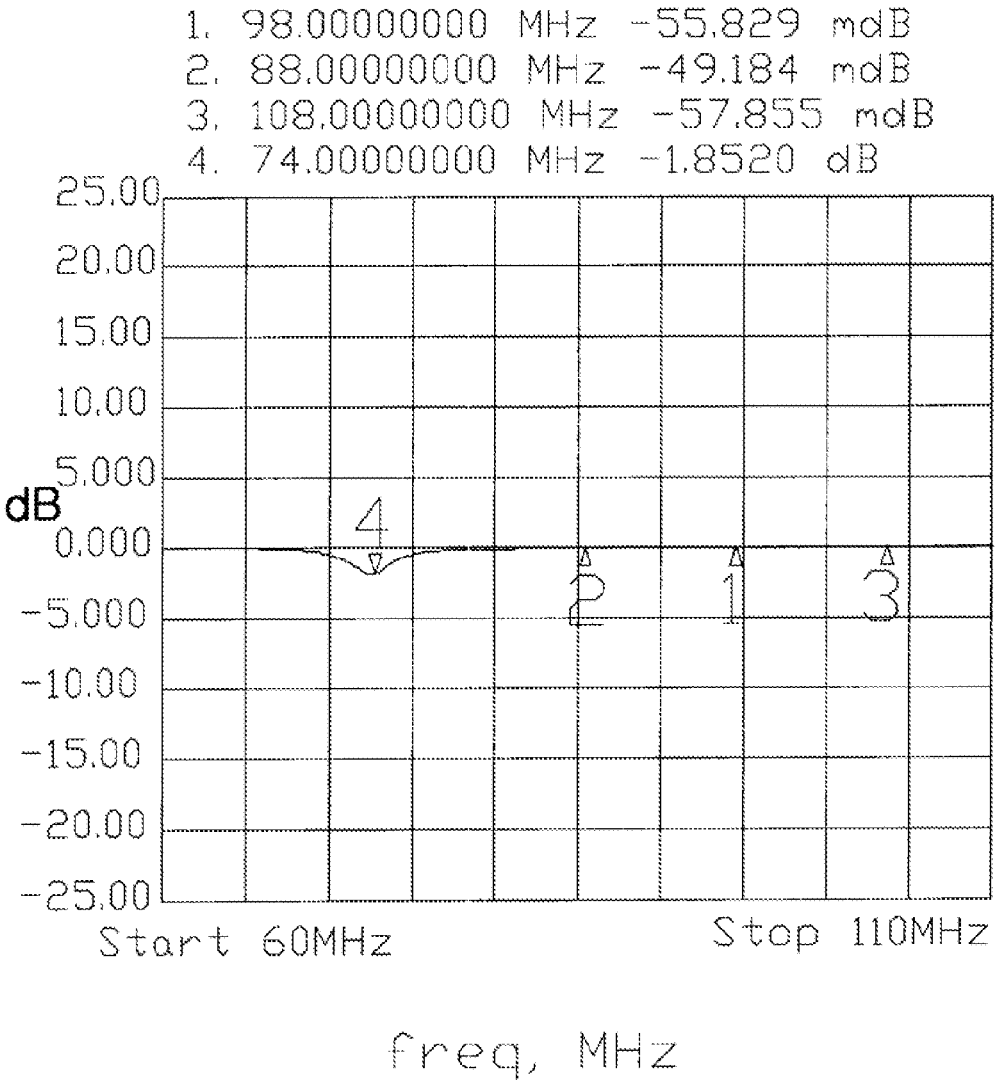
FIG. 3C is a reflection coefficient when, among a plurality of helical conductors constituting the helical antenna of FIG. 3B, the helical conductor connected to a ground plane is not present.
Figure 3D:
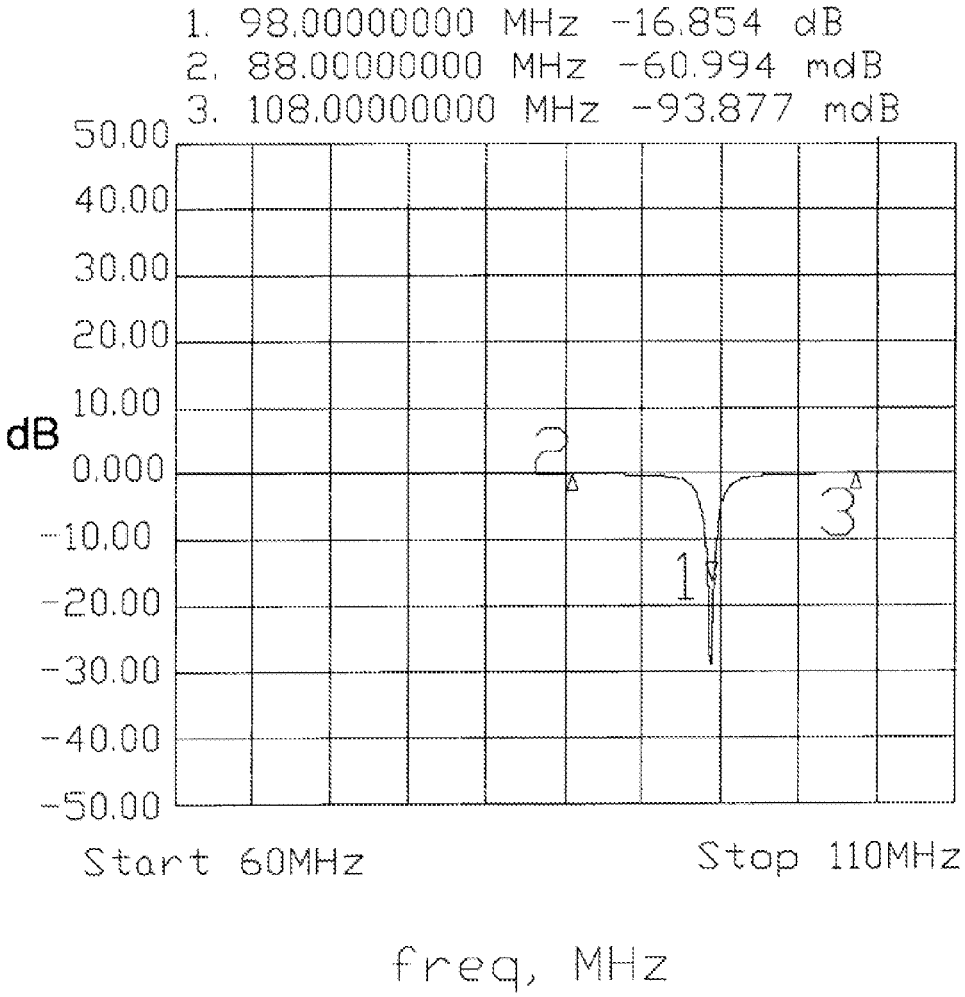
FIG. 3D is a reflection coefficient when, among a plurality of helical conductors constituting the helical antenna of FIG. 3B, the helical conductor connected to a ground plane is present.

FIGS. 3C and 3D show reflection coefficient graphs when, of the helical conductors for the helical antenna of FIG. 3B, one connected to the ground plane is present and is not, respectively.

As shown in FIGS. 3C and 3D, it can be found that, when two radiators resonating at 74 MHz are electrically connected and electromagnetically coupled to the feeder circuit and the ground plane, respectively, as in the embodiment of the present invention, they resonate at 98 MHz.

In this manner, the helical radiation unit provided to the broadcasting antenna according to the embodiment of the present invention can be designed to operate at a specific frequency band in spite of increasing the length of the antenna within the restricted space, compared to the normal mode helical antenna.

Meanwhile, in typical normal mode helical antennas, due to the helical spring structure, the magnetic fields are added, so that the density of the magnetic field is formed so as to be relatively higher than that of the electric field, and thus the radiation efficiency is reduced. For this reason, the broadcasting antenna 100 according to the embodiment of the present invention is configured to increase the intensity of the electric field to prevent the radiation efficiency from being reduced. To this end, the top loaders 121 and 122 of the extended radiation unit 120 are electrically connected to the helical radiators 101 and 102 of the helical radiation unit 110, having the coupling feed structure, respectively.

Figure 4:
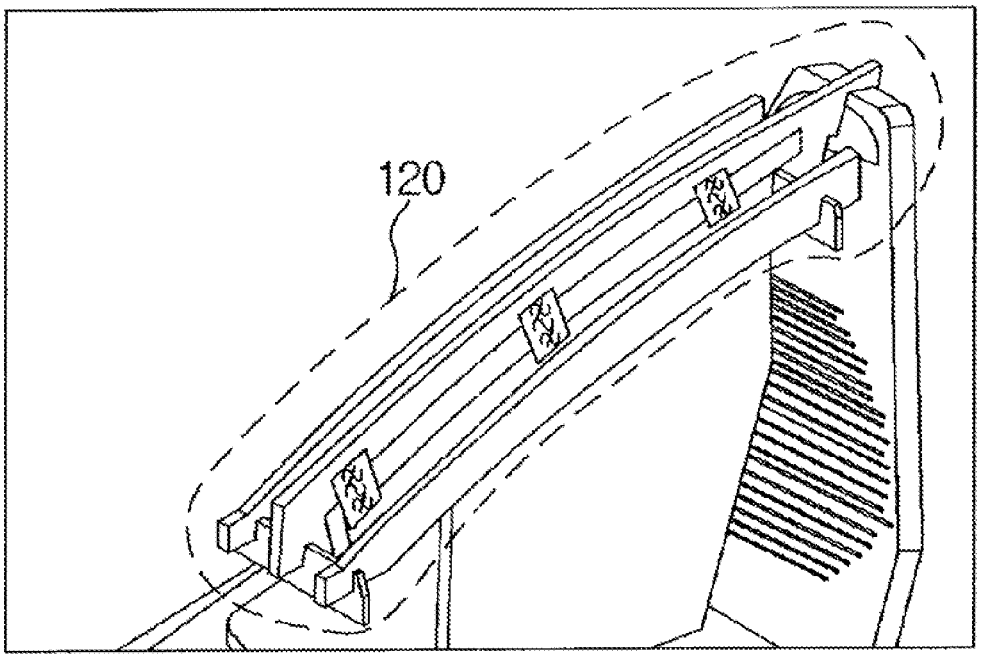
FIG. 4 is a perspective view showing the extended radiation unit of the broadcasting antenna according to the embodiment of the present invention.

FIG. 4 is a perspective view showing the extended radiation unit of the broadcasting antenna according to the embodiment of the present invention.

As shown in FIG. 4, the extended radiation unit 120 includes the first top loader 121 that is electrically connected to the end of the first helical radiator 101 of the helical radiators 101 and 102 of the helical radiation unit 110, the second top loader 122 that is electrically connected to the end of the second helical radiator 102 of the helical radiation unit 110, and an extended dielectric board (without a reference numeral) on which the first and second top loaders 121 and 122 are formed.

In the broadcasting antenna according to the embodiment of the present invention, first connection patterns 33 are formed on the opposite surfaces of the main dielectric board 103 of the helical radiation unit 110, respectively, and are electrically connected to the first helical radiator 101 and first top loader 121. Thereby, a first antenna unit (without a reference numeral) is formed. Second connection patterns 33 are electrically connected to the second helical radiator 102 and the second top loaders 122. Thereby, a second antenna unit (without a reference numeral) is formed. The first antenna unit and the second antenna unit are coupled, so that the broadcasting antenna operates at a double frequency band according to a coupled amount as described below.

In the embodiment of the present invention, a relatively high frequency of two frequencies is designed to fall within the FM broadcasting frequency band of FIGS. 3A to 3D. The antenna in which the two antenna units are coupled operates at a frequency band that is higher than a frequency corresponding to a length of each antenna unit, as described in FIGS. 3A to 3D. As such, the broadcasting antenna according to the embodiment of the present invention increases the antenna length at a specific frequency band to improve the bandwidth, and thus improves the radiation efficiency. Further, since AM broadcasting antennas generally operate at a frequency of a long wavelength, it is difficult to tune the frequency in the antenna for a vehicle. However, the broadcasting antenna according to the embodiment of the present invention is designed to receive such a long wavelength frequency. Thus, the broadcasting antenna according to the embodiment of the present invention operates at a double frequency band of an AM broadcasting frequency band from 500 KHz to 1.7 MHz and an FM broadcasting frequency band from 88 MHz to 108 MHz.

Hereinafter, the extended radiation unit of FIG. 4 will be described in greater detail with reference to FIGS. 5 to 7.

Figure 5:
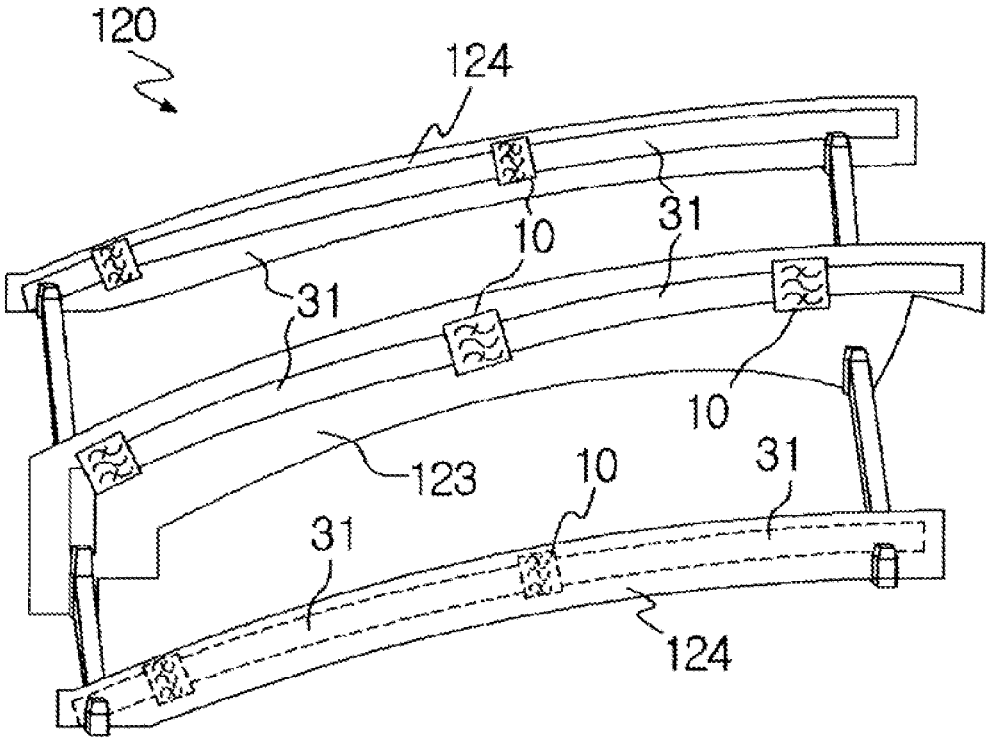
FIG. 5 is a schematic view showing a configuration of the extended radiation unit of FIG. 4.
Figure 6:
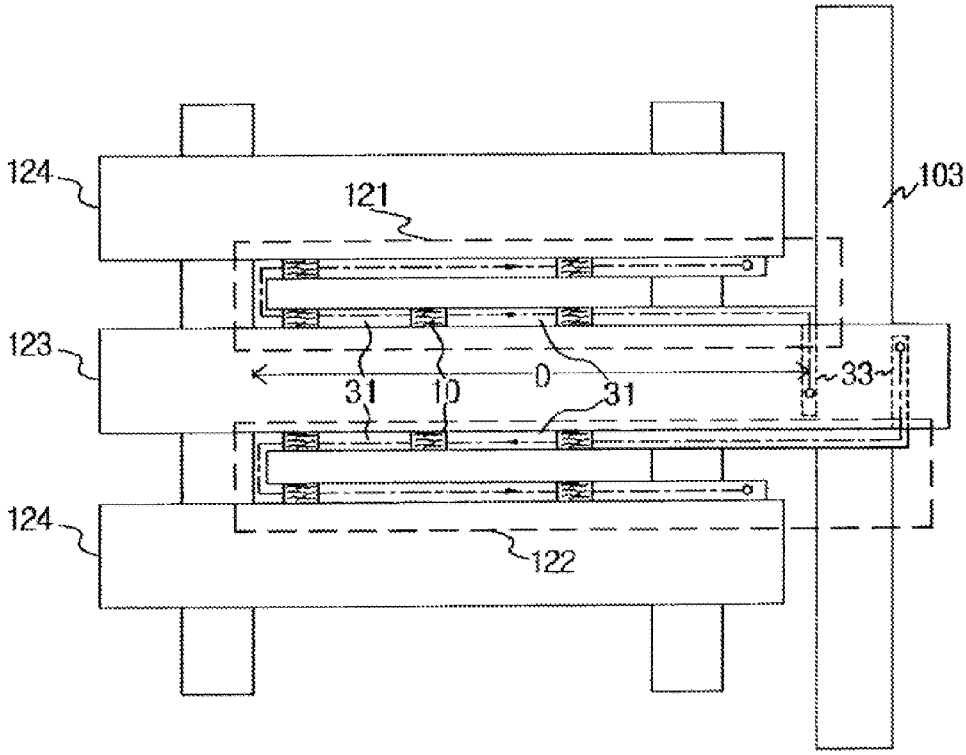
FIG. 6 is a schematic plane view showing top loaders installed on the extended radiation unit of FIG. 5.

FIG. 5 is a schematic view showing a configuration of the extended radiation unit of FIG. 4, and FIG. 6 is a schematic plane view showing top loaders installed on the extended radiation unit of FIG. 5.

As shown, in the embodiment of the present invention, the extended dielectric board constituting the extended radiation unit 120 is made up of an extended common dielectric board 123, on opposite surfaces of which parts of the first and second top loaders 121 and 122 are coupled and formed in the lengthwise direction (second direction) of the main board 1, and a plurality of extended independent dielectric boards 124, on first surfaces of which the other parts of the first and second top loaders 121 and 122 continue to be formed in a direction (third direction) opposite to a direction in which the parts of the first and second top loaders 121 and 122 are formed, in order to reduce the entire size of the antenna within a restricted space.

Here, a length D by which the first and second top loaders 121 and 122 are coupled on the opposite surfaces of the common dielectric board 123 is adjusted. That is, a coupled amount is adjusted to control the radiation efficiency.

Figure 7:
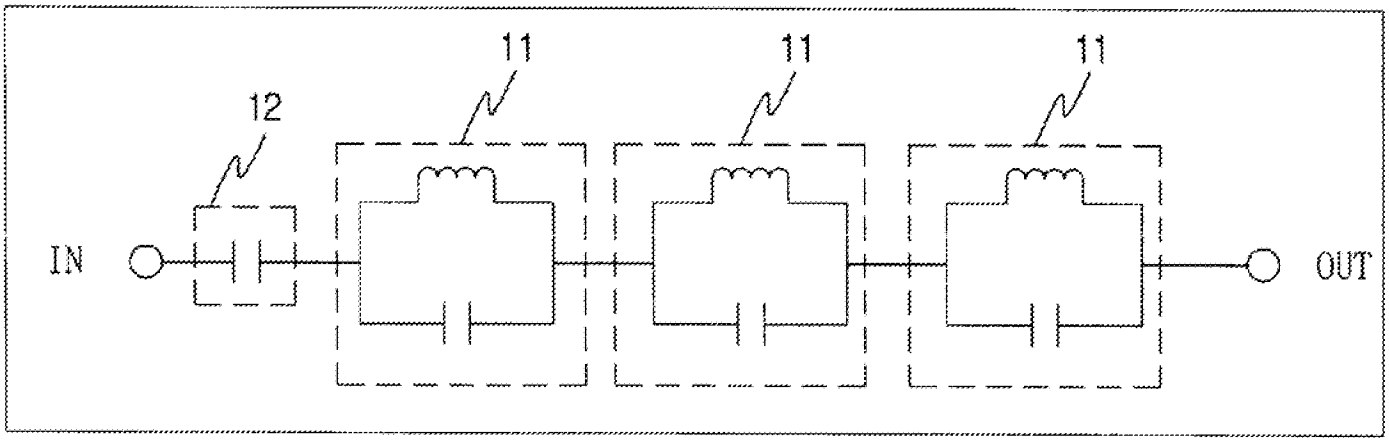
FIG. 7 is an equivalent circuit showing a band stop filtering unit constituting the top loaders of the extended radiation unit of FIG. 6.

FIG. 7 is an equivalent circuit showing a band stop filtering unit constituting the top loaders of the extended radiation unit of FIG. 6.

The broadcasting antenna 100 according to the embodiment of the present invention is configured to form a band stop filter 11 using at least one LC resonant filter made up of a chip capacitor and a chip inductor in order to reduce the entire size of the antenna within a restricted space, and an impedance matching element 12 using a chip capacitor.

Here, when a plurality of interference signals are present, a plurality of band stop filter 11 are formed in series so as to have one-to-one correspondence to an operating frequency of the interference signal operating a different frequency band, and the LC resonant filter may be formed as a single low pass filter that passes only a frequency band of 108 MHz or less so as to be able to pass only the frequency band at which the broadcasting antenna according to the embodiment of the present invention operates.

Figure 8:
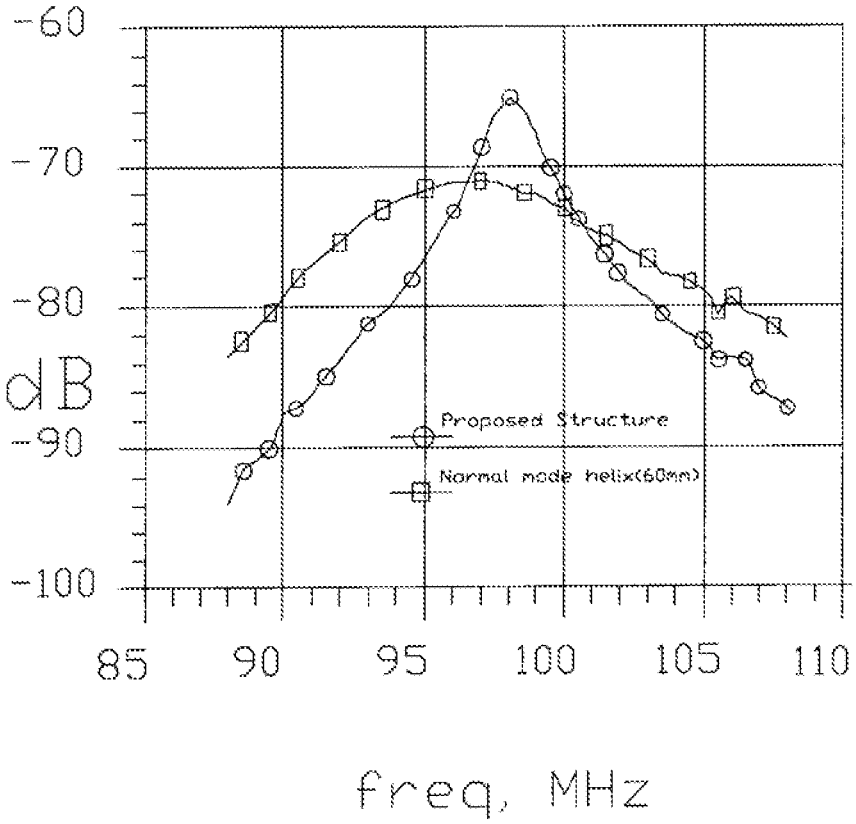
FIG. 8 is a graph showing a result of comparing radiation efficiencies of the normal mode helical antenna of FIG. 3A and the broadcasting antenna according to the embodiment of the present invention at an operating frequency band having the same resonant frequency of 98 MHz.

FIG. 8 is a graph showing a result of comparing radiation efficiencies of the normal mode helical antenna of FIG. 3A and the broadcasting antenna according to the embodiment of the present invention at an operating frequency band having the same resonant frequency of 98 MHz in terms of an average of insertion losses.

As shown, at the operating frequency band of 98 MHz, about −72 dB is improved to about −64 dB, and thus it can be found that the broadcasting antenna having the helical radiation unit made up of the two helical radiators having the coupling feed structure are relatively improved in radiation efficiency compared to the normal mode helical antenna having a single helical conductor. Thus, the radiation efficiency is improved at a relatively high frequency band of the double frequency band at which the first and second antenna units are coupled and operated.

In this manner, the broadcasting antenna according to the embodiment of the present invention includes the helical radiation unit that is made up of the plurality of helical radiators and has the coupling feed structure, and the extended radiation unit made up of the plurality of top loaders that are electrically connected to the ends of the plurality of helical radiators, and each includes at least one band stop filtering unit and a plurality of conductive patterns between which the band stop filtering unit is disposed. Thereby, the broadcasting antenna can be made small within a restricted space, operate at a specific frequency band in spite of an increase in length, improve the radiation efficiency, and prevent the signal interference.

Figure 9:
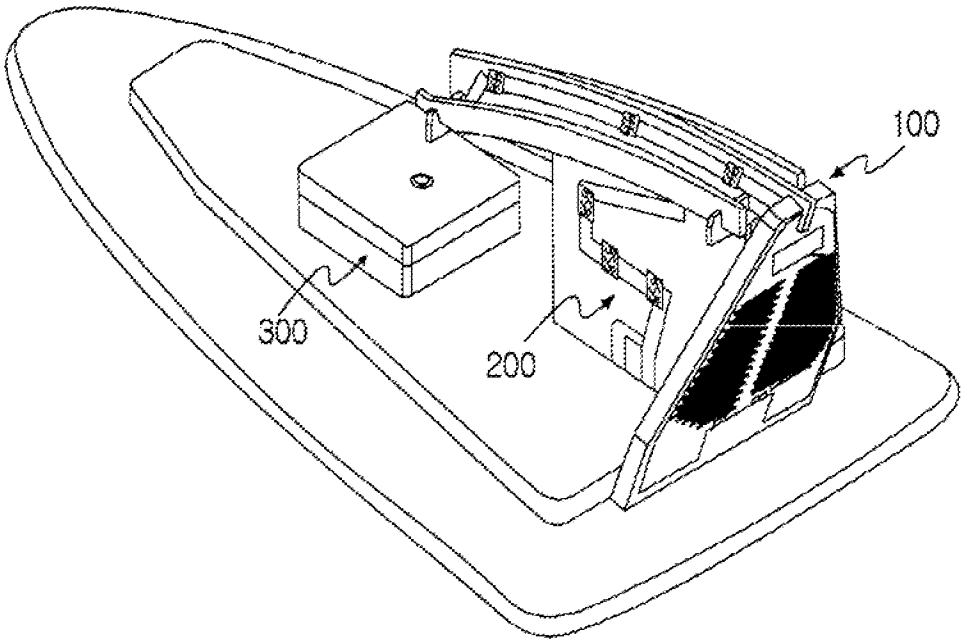
FIG. 9 is a perspective view showing a shark fin antenna apparatus having the broadcasting antenna according to another embodiment of the present invention.
Figure 10:
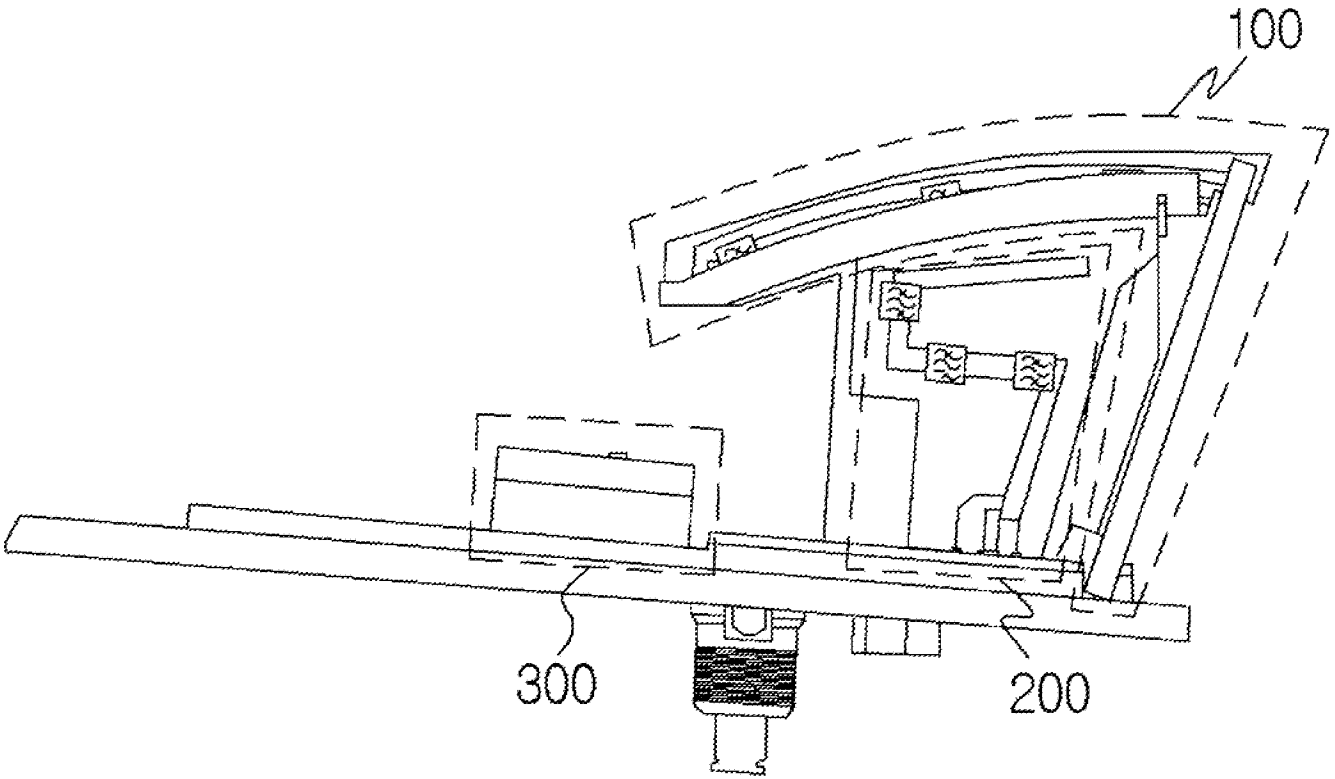
FIG. 10 is a side view showing the shark fin antenna apparatus having the broadcasting antenna according to the other embodiment of the present invention.

FIG. 9 is a perspective view showing a shark fin antenna apparatus having the broadcasting antenna according to another embodiment of the present invention, and FIG. 10 is a side view showing the shark fin antenna apparatus shown in FIG. 9.

As shown, the shark fin antenna apparatus according to another embodiment of the present invention includes a broadcasting antenna 100 for a vehicle, a mobile communication antenna 200, and a circularly polarized ceramic patch antenna 300 for the vehicle.

In the other embodiment, the broadcasting antenna operates at an AM broadcasting frequency band from 500 KHz to 1.7 MHz and at an FM broadcasting frequency band from 88 MHz to 108 MHz. The mobile communication antenna operates at a cellular frequency band from 824 MHz to 894 MHz and at a US PCS frequency band from 1.850 GHz to 1.990 GHz. The circularly polarized ceramic patch antenna operates at a digital satellite radio frequency band from 2.332 GHz to 2.345 GHz.

In detail, the broadcasting antenna 100 includes a helical radiation unit 110 which is made up of a plurality of helical radiators 101 and 102 that are electrically connected to a feeder circuit and a ground plane of a main board 1, are formed in an upward direction (first direction) of the main board 1, and are coupled apart from each other and which have a coupling feed structure, and an extended radiation unit 120 which has a plurality of top loaders 121 and 122 that are electrically connected to ends of the helical radiators 101 and 102, are formed in a lengthwise direction (second direction) of the main board 1, and are coupled to each other. Each of the top loaders 121 and 122 includes at least one band stop filtering unit 10 and a plurality of conductive patterns 31 between which the band stop filtering unit 10 is disposed. Detailed description of configurations having the same characteristics as the configurations repeated in FIGS. 1 to 8 will be omitted.

In the broadcasting antenna 100 according to the other embodiment of the present invention, the first band stop filtering unit 10 is preferably made up of three band stop filters 11 that are formed in series so as to correspond to the frequency bands at which the mobile communication antenna 200 and the circularly polarized ceramic patch antenna 300 operate in order to remove interference signals.

Further, to prevent the conductive patterns 31 from serving as antenna radiators, the conductive patterns 31 constituting each of the top loaders 121 and 122 are each formed at a shorter length than λ/8 of an operating frequency within a relatively highest frequency band of the frequency bands at which the mobile communication antenna 200 and the circularly polarized ceramic patch antenna 300 operate, i.e. for the digital satellite radio frequency band of the circularly polarized ceramic patch antenna 300.

The mobile communication antenna 200 is formed in an upward direction of the main board 1, includes at least one second band stop filtering unit 20 and a plurality of conductive patterns 32 between which the second band stop filtering unit 20 is disposed on one side of a dielectric board 103, on opposite upper surfaces of which the top loaders 121 and 122 constituting the extended radiation unit 120 of the broadcasting antenna 100 are partly disposed, and has a P shape.

Further, the circularly polarized ceramic patch antenna 300 includes a patch antenna 310 at a predetermined position on the main board 1 on which the broadcasting antenna 100 and the mobile communication antenna 200 are located, and an extended ground 320 that is formed of a metal conductor having the same shape as the patch antenna 310 and is electrically connected with the ground plane.

Hereinafter, the shark fin antenna apparatus according to the other embodiment of the present invention will be described in greater detail with reference to FIGS. 11 to 14.

Figure 11:
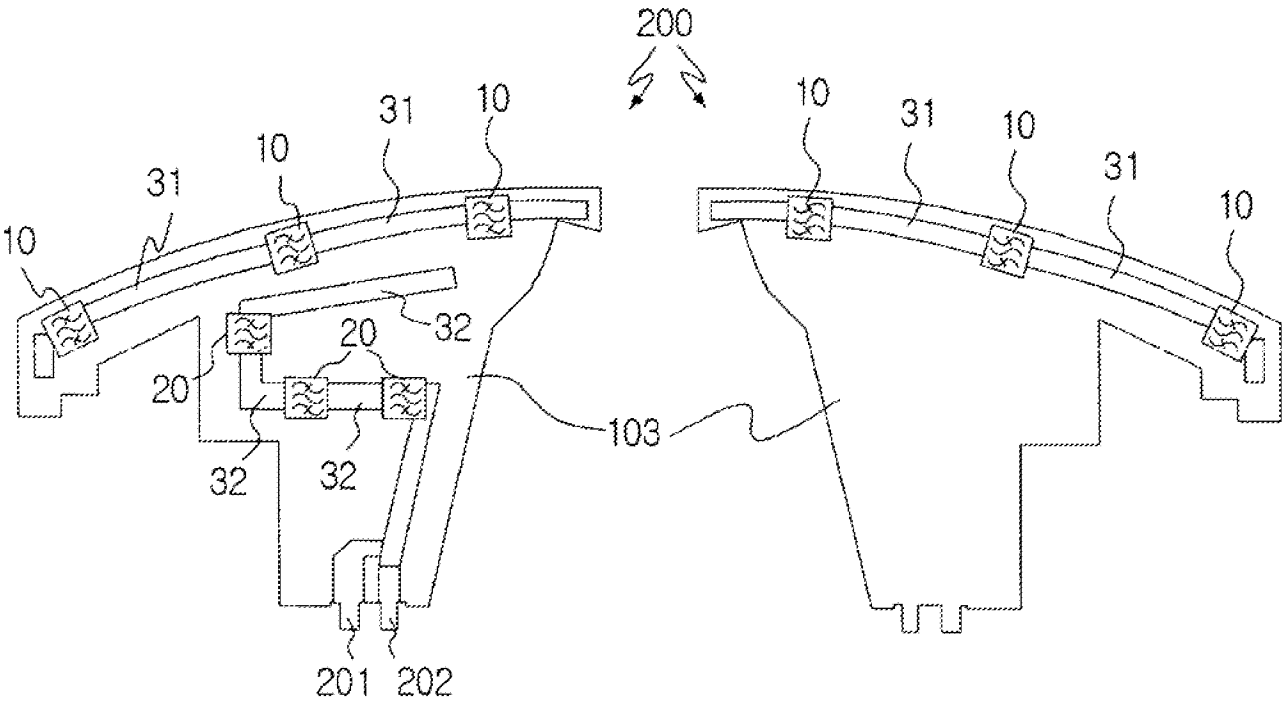
FIG. 11 schematically shows a mobile communication antenna installed on the shark fin antenna apparatus of FIG. 9 when viewed from the front and rear.
Figure 12:
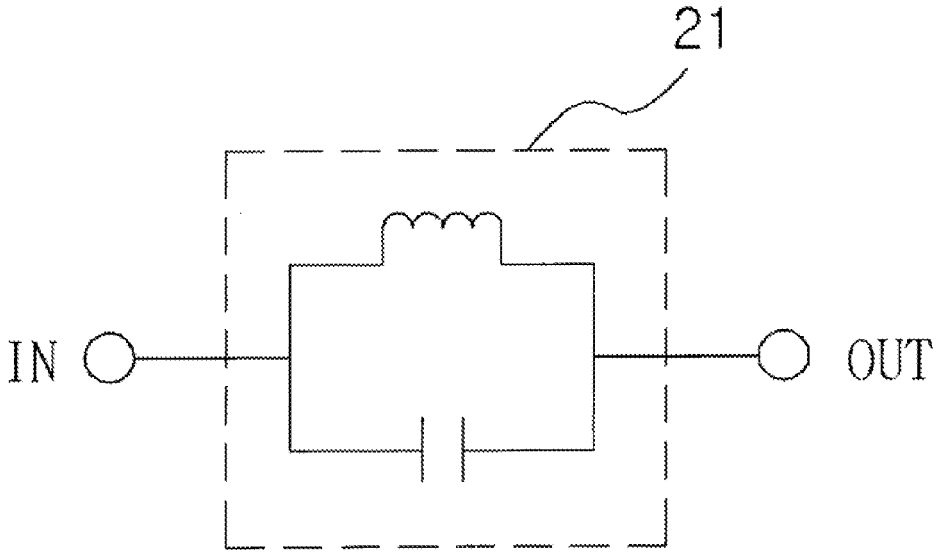
FIG. 12 is an equivalent circuit showing a second band stop filtering unit installed on the mobile communication antenna of FIG. 11.

FIG. 11 schematically shows a mobile communication antenna installed on the shark fin antenna apparatus of FIG. 9 when viewed from the front and rear. FIG. 12 is an equivalent circuit showing a second band stop filtering unit installed on the mobile communication antenna of FIG. 11.

As shown, the mobile communication antenna 200 installed on the shark fin antenna apparatus according to the other embodiment of the present invention is formed in a P-shaped antenna pattern on one side of the dielectric board 103 including the at least one second band stop filtering unit 20 that removes interference signals occurring when the broadcasting antenna 100 operates, and the conductive patterns 32 between which the second band stop filtering unit 20 is disposed, and includes a feeder pattern 201 that is electrically connected with the feeder circuit of the main board 1 on one side of the conductive pattern 32 adjacent to the main board 1 among the conductive patterns 32, and a ground pattern 202 that is electrically connected to the ground plane of the main board 1.

Here, the band stop filtering unit 20 installed on the mobile communication antenna 200 is designed as a single high pass filter 21 that passes only signals of a frequency band higher than the frequency band at which the broadcasting antenna 100 operates, and uses an LC resonant filter made up of a chip capacitor and a chip inductor in order to reduce the entire size of the antenna within a restricted space. The conductive patterns 32 provided to the mobile communication antenna 200 are each formed at a shorter length than λ/8 of an FM broadcasting operating frequency within a relatively high frequency band of the double frequency band at which the broadcasting antenna 100 operates in order to prevent the conductive patterns 32 from serving as the antenna radiators.

In this way, the shark fin antenna apparatus according to the other embodiment of the present invention is provided therein with the mobile communication antenna that includes the second band stop filtering unit removing the interference signals generated by the broadcasting antenna disposed adjacent thereto and the conductive patterns between which the second band stop filtering unit is disposed, and that improves the radiation efficiency.

Figure 13:
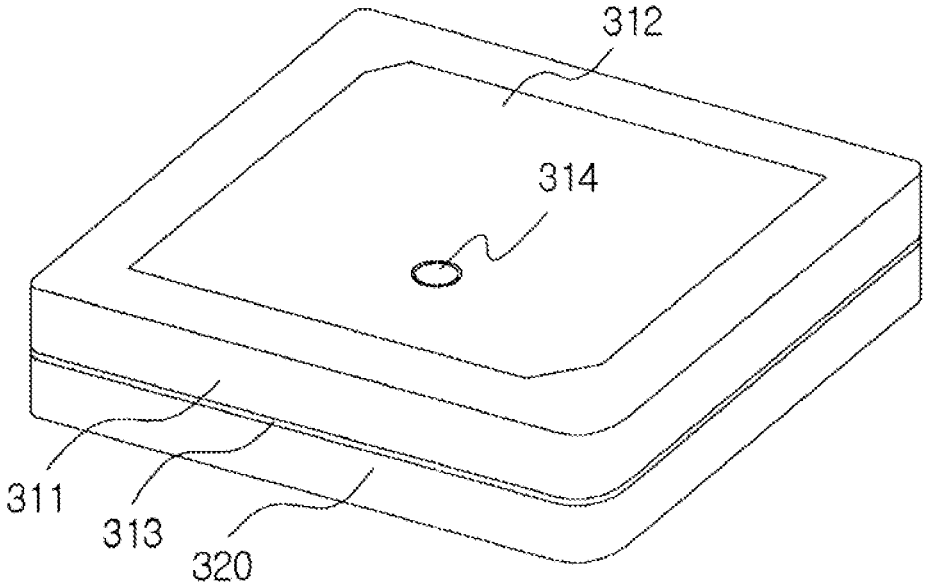
FIG. 13 is a schematic view showing a configuration of a circularly polarized ceramic patch antenna installed on the shark fin antenna apparatus of FIG. 9.
Figure 14:
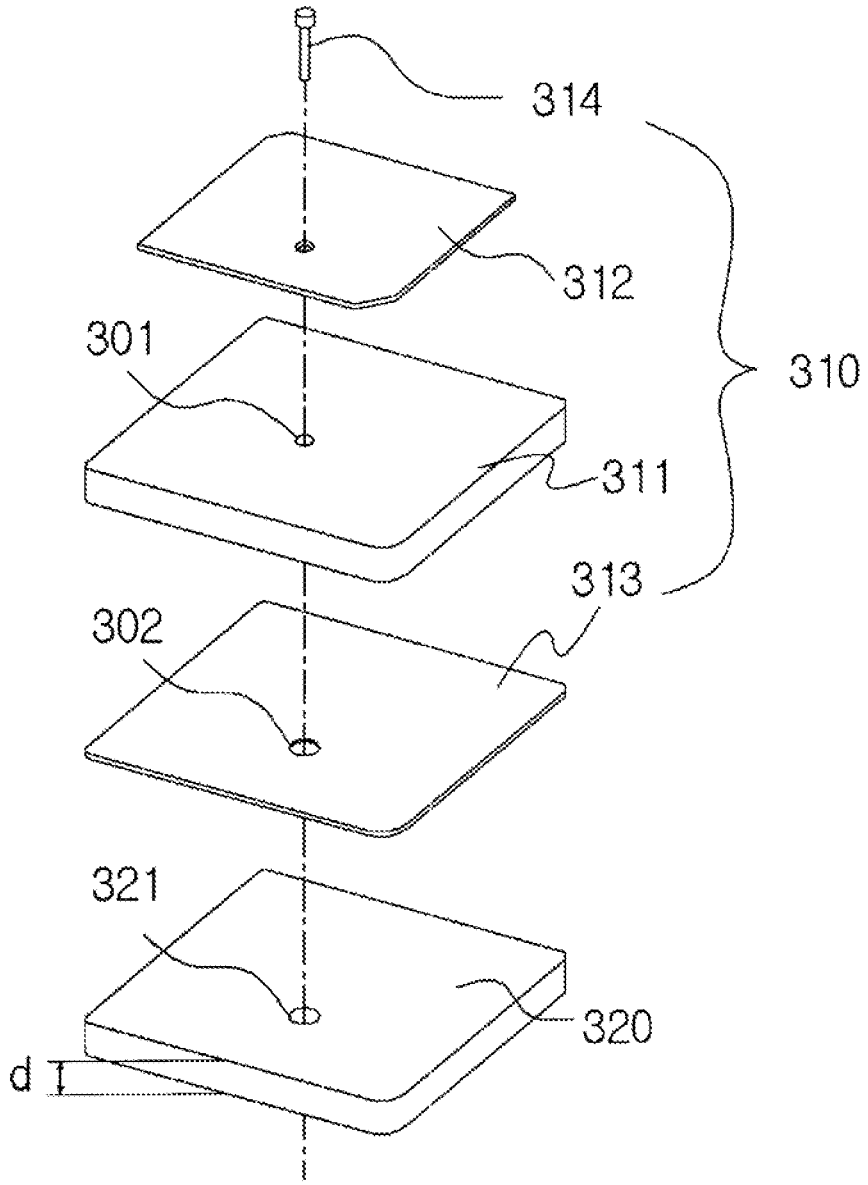
FIG. 14 is an exploded perspective view showing the circularly polarized ceramic patch antenna of FIG. 13.

FIG. 13 is a schematic view showing a configuration of a circularly polarized ceramic patch antenna installed on the shark fin antenna apparatus of FIG. 9, and FIG. 14 is an exploded perspective view showing the circularly polarized ceramic patch antenna of FIG. 13.

As shown, the circularly polarized ceramic patch antenna 300 includes: a patch antenna unit 310 having a dielectric 311 through which a first feeder hole 301 is bored and which is formed of a ceramic, a patch radiator 312 that is formed of a quadrilateral metal thin film, diagonally opposite corners of which are partly chamfered for circular polarization, and that is formed on the dielectric 311, a main ground 313 through which a second feeder hole 302 is bored at a position corresponding to the first feeder hole 301 so as to be greater in diameter than the feeder hole 301 and which is formed of a metal thin film placed under the dielectric 311, and a feeder pin 314 that connects the patch radiator 312 and the feeder circuit on the main board 1 through the first and second feeder holes 301 and 302; and an extended ground 320, through which a third feeder hole 321 is bored so as to correspond to the second feeder hole 302, which is formed under the patch antenna unit 310, which has a predetermined thickness, which is formed of a metal conductor having a shape which is the same as a shape of the patch antenna unit 310, and which is electrically connected to a ground plane formed on the main board 1.

In detail, among the components of the patch antenna unit 310, the patch radiator 312 is formed of a quadrilateral metal thin film, opposite corners of which are partly chamfered to provide the circular polarization, and the main ground 313 is formed of a metal thin film on a bottom surface of the dielectric 311. The extended feeder 320 has a predetermined thickness, and is formed of a metal conductor having the same shape as the patch antenna unit 310. Here, the circular polarization formed at the patch radiator 312 of the patch antenna unit 310 is preferably left-hand circular polarization (LHCP) suitable for the reception of digital satellite radio broadcasting in North America.

Further, the dielectric 311, the main ground 313, and the extended ground 320 have first to third feeder holes 301, 302, and 321, and the feeder pin 314 for electrical connection with the patch radiator 312 is inserted into the feeder holes. Thus, the feeder pin 340 is electrically connected with the patch radiator 312. Thereby, a feed signal applied from the feeder circuit formed on the main board 1 is transmitted to the patch radiator 312. In this case, the second and third feeder holes 302 and 303 formed in the main ground 313 and the extended ground 320 are preferably greater in diameter than the first feeder hole 301 such that the feeder pin 314 having a rod shape can be insulated from the main ground 313 and the extended ground 320.

On the other hand, the extended ground 320 is provided below the patch antenna unit 310, and interacts with the main ground 313 of the patch antenna unit 310 by forming an electrical connection with the ground plane formed on the main board 1. Thereby, a null point generated between the patch radiator 312 of the patch antenna unit 310 and the ground plane is reduced.

Further, in the other embodiment of the present invention, the dielectric 311 of the patch antenna unit 310 is formed of a ceramic having permittivity of 15 and a height of 4 mm. The dielectric 311 may be formed of one of various ceramics having permittivity between 4.0 and 110.

Generally, the permittivity of ceramics covers a very wide range compared to materials used as conventional dielectrics, and the ceramics are very high in stability in terms of being able to resist changes in temperature, and are suitable for making the patch antenna light in weight and small in size.

In the other embodiment of the present invention, the main ground 313 of the patch antenna unit 310 is provided across the entire bottom surface of the dielectric 311. The patch antenna unit 310 includes the rod-shaped feeder pin 314. The feeder pin 314 is inserted into the feeder holes 301 and 302 formed in the dielectric 311 and the main ground 313, and is electrically coupled with the patch radiator 312, so that a desired impedance characteristic can be properly changed by adjusting its position. Here, the diameter of the feeder pin 314 corresponds to the diameter of the first feeder hole 301 formed in the dielectric 311.

In the other embodiment of the present invention, the thickness d of the extended ground 320 formed under the patch antenna unit 310 is adjusted, so that the radiation efficiency of a specific frequency band at which the patch radiator 312 of the patch antenna unit 310 operates can be adjusted.

Further, because of a field effect generated between the patch radiator 312 of the patch antenna unit 310 and the ground plane formed on the main board 1, the extended ground 320 is preferably formed so that the thickness thereof is between 0.03λ and 0.2λ of an operating frequency such that the directivity of a radiation pattern formed in a direction parallel to the ground plane is improved. In the other embodiment of the present invention, the circularly polarized ceramic patch antenna reduces the null point by adjusting the thickness of the extended ground, so that the antenna gain thereof is increased by more than 1 dB.

In this manner, the shark fin antenna apparatus according to the other embodiment of the present invention is provided therein with the circularly polarized ceramic patch antenna in which the extended ground is formed under a patch antenna, has a predetermined thickness, is formed of a metal conductor having the same shape as the patch antenna unit, and is electrically connected to a ground plane formed on a main board. The thickness of the extended ground can be adjusted, so that it is possible to adjust the radiation efficiency at a specific frequency band. Thus, the directivity of a radiation pattern formed in a direction parallel to the ground plane is improved, and the null point caused by the field effect is reduced to increase the antenna gain.

FIGS. 15 to 20 show results of comparing antenna characteristics before and after the other embodiment of the present invention is applied at operating frequency bands of 859 MHz, 1920 MHz, and 2345 MHz.

Figure 15:
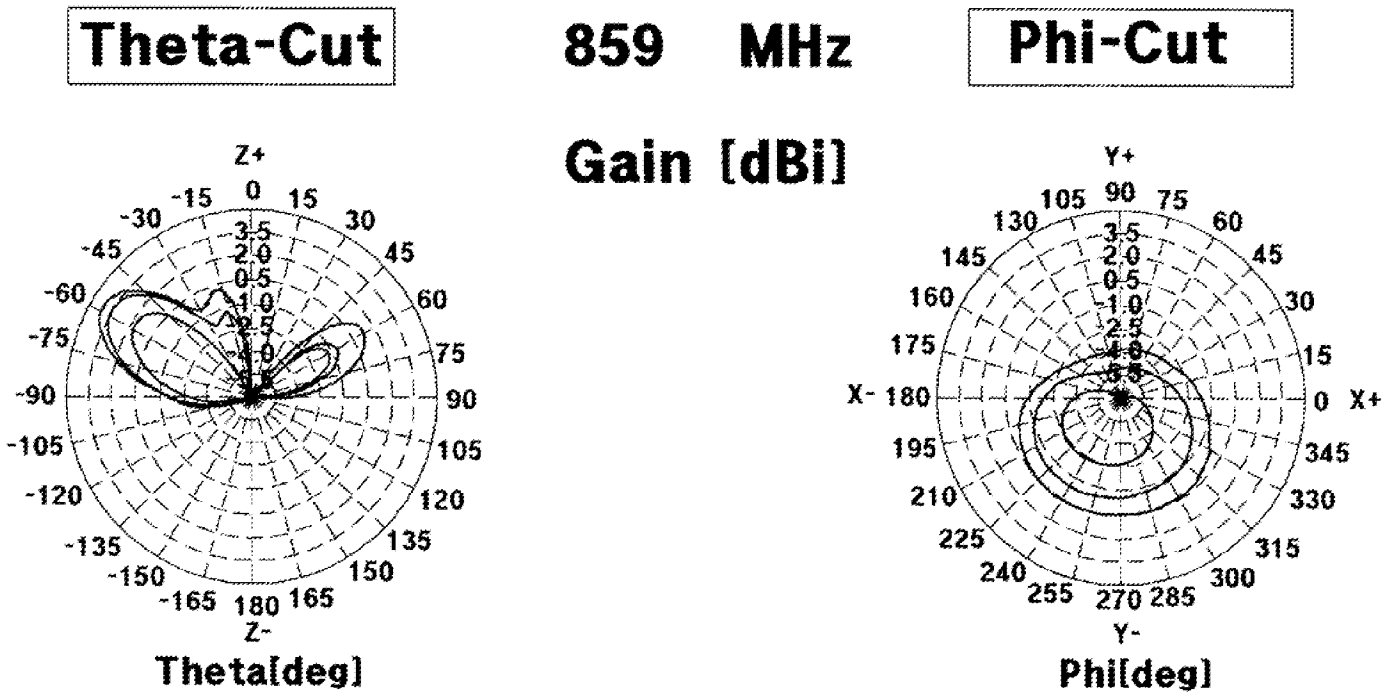
FIGS. 15 and 16 show antenna characteristics of the mobile communication antenna before and after the other embodiment of the present invention is applied at an operating frequency band of 859 MHz.
Figure 16:
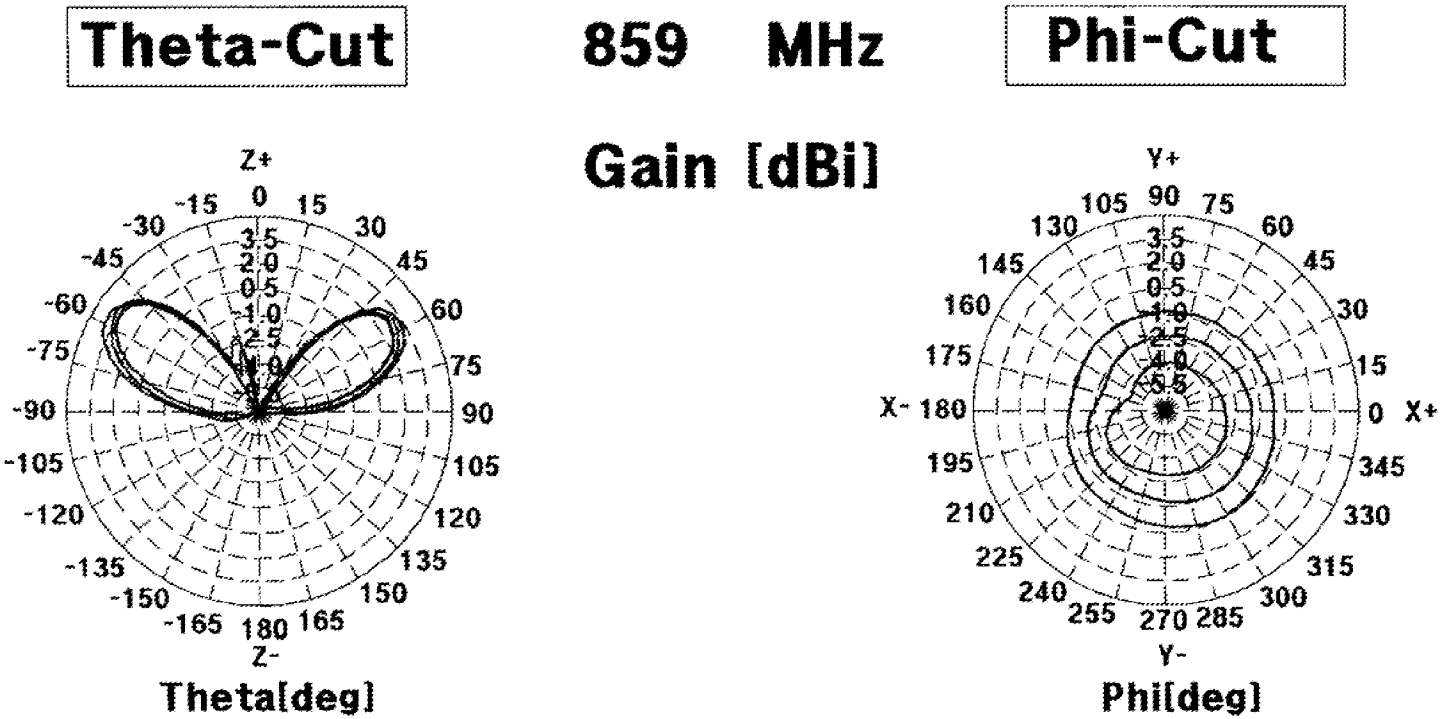

FIGS. 15 and 16 correspond to the comparison of antenna characteristics of the mobile communication antenna that operates at an operating frequency band of 859 MHz. It can be found that both the radiation pattern biased in a direction of 270° and the radiation efficiency are improved.

Figure 17:
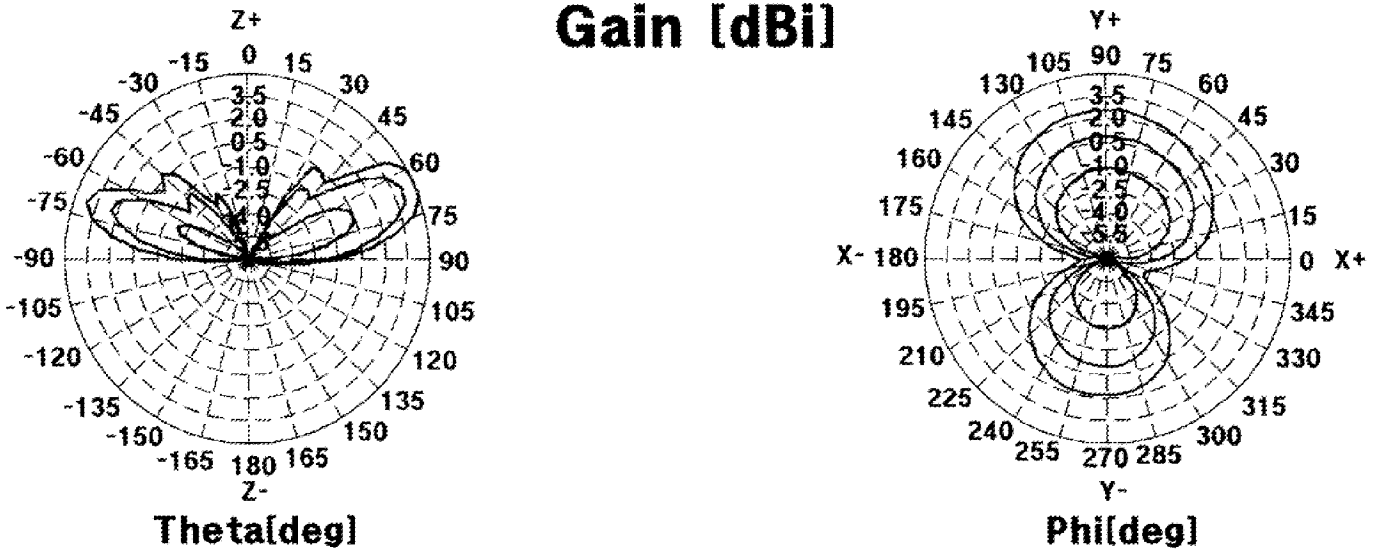
FIGS. 17 and 18 show antenna characteristics of the mobile communication antenna before and after the other embodiment of the present invention is applied at an operating frequency band of 1920 MHz.
Figure 18:
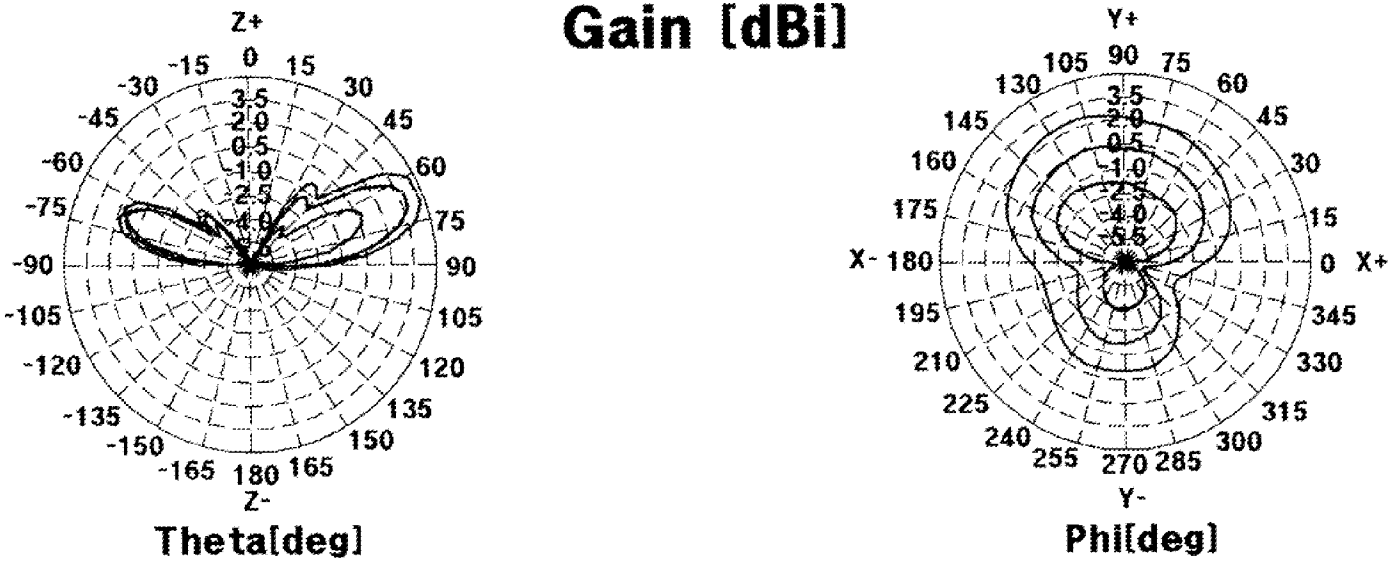

FIGS. 17 and 18 correspond to the comparison of antenna characteristics of the mobile communication antenna that operates at an operating frequency band of 1920 MHz. It can be found that the null point generated in directions of 0° and 180° is improved.

Figure 19:
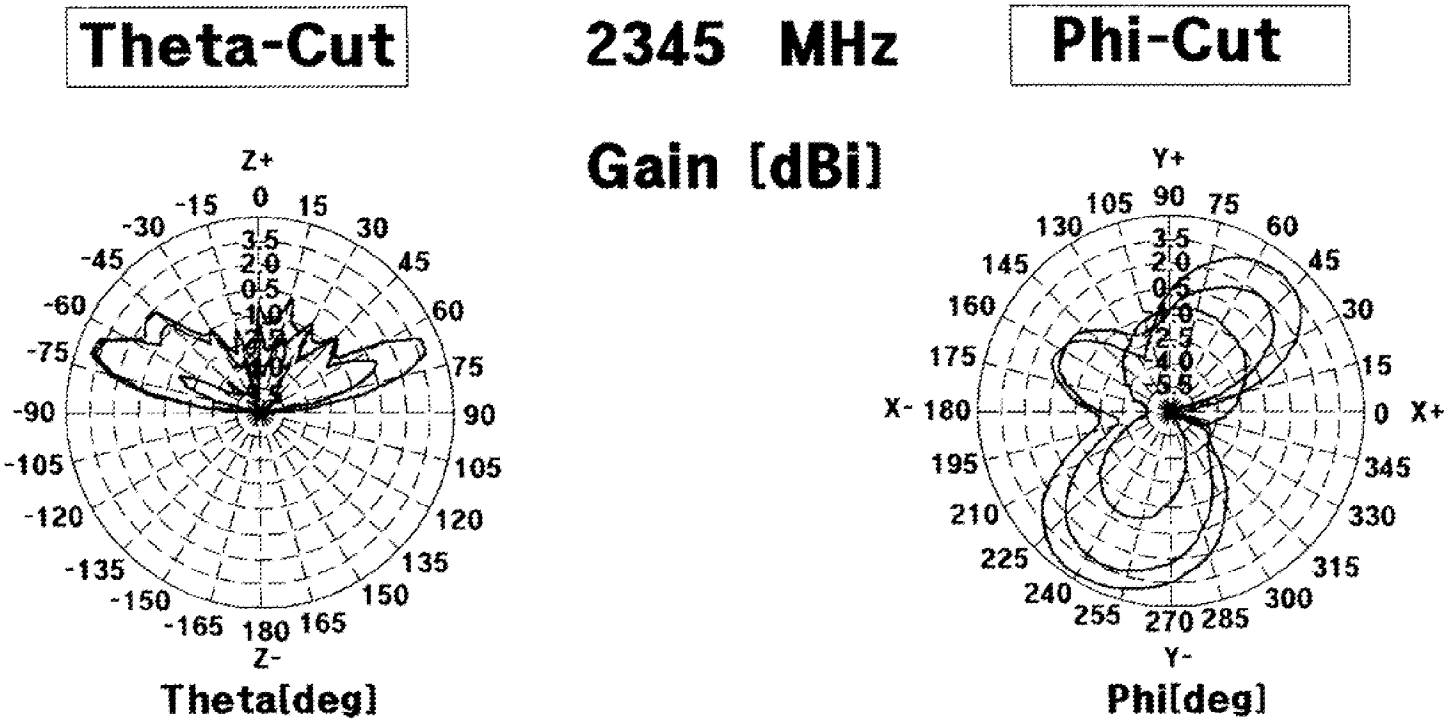
FIGS. 19 and 20 show antenna characteristics of the mobile communication antenna before and after the other embodiment of the present invention is applied at an operating frequency band of 2345 MHz.
Figure 20:
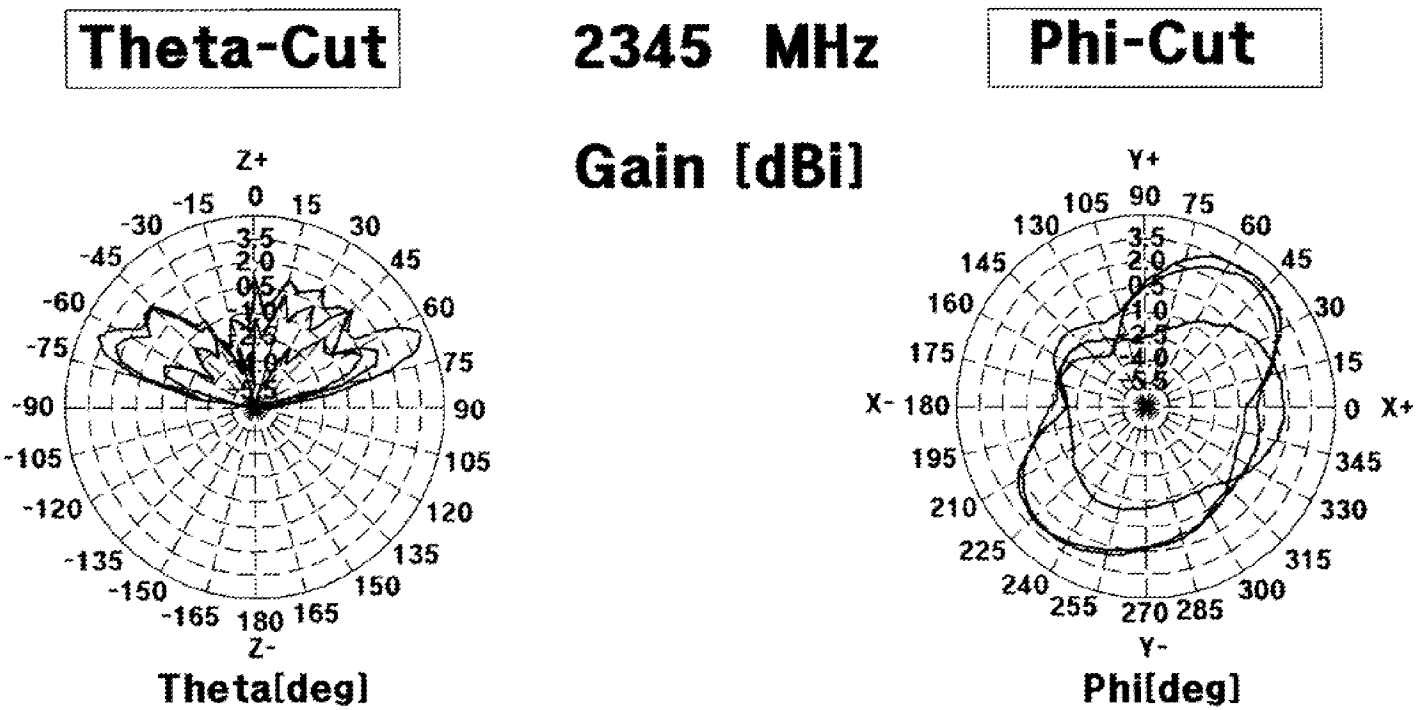

FIGS. 19 and 20 correspond to the comparison of antenna characteristics of the circularly polarized ceramic patch antenna that operates at an operating frequency band of 2345 MHz. It can be found that both the null point generated in the direction of about 0° and the radiation efficiency are improved.

As described above, the shark fin antenna apparatus according to the other embodiment of the present invention includes: the broadcasting antenna that includes the helical radiation unit having the coupling feed structure, and the extended radiation unit made up of the plurality of top loaders that are electrically connected to the ends of the plurality of helical radiators and each include at least one band stop filtering unit and a plurality of conductive patterns between which the band stop filtering unit is disposed, and that can be made small within a restricted space, operate at a specific frequency band in spite of an increase in length, improve the radiation efficiency, and prevent the signal interference; the mobile communication antenna that includes the second band stop filtering unit removing the interference signals and the conductive patterns between which the second band stop filtering unit is disposed, and that improves the radiation efficiency; and the circularly polarized ceramic patch antenna in which the extended ground is formed under a patch antenna, has a predetermined thickness, is formed of a metal conductor having the same shape as the patch antenna unit, and is electrically connected to a ground plane formed on a main board, and in which the thickness of the extended ground can be adjusted to control the radiation efficiency at a specific frequency band.

While the embodiment of the present invention has been described for illustrative purposes, it is apparent to those skilled in the art that various modifications, additions, and substitutions are possible, without departing from the scope and spirit of the invention as disclosed in the accompanying claims.

What is claimed is:

1. A shark fin antenna apparatus having a broadcasting antenna for a vehicle, which includes a main board on which a feeder circuit and a ground plane are formed and which is formed on the main board, the shark fin antenna apparatus comprising:

the broadcasting antenna that includes: a helical radiation unit which includes a plurality of helical radiators that are electrically connected to the feeder circuit and the ground plane of the main board, that are formed in a first direction, and that are coupled apart from each other by a predetermined interval, and which has a coupling feed structure; and an extended radiation unit which includes a plurality of top loaders that are electrically connected to ends of the plurality of helical radiators, respectively, that are formed in a second direction, and that are coupled to each other, the plurality of top loaders each including at least one band stop filtering unit and a plurality of conductive patterns between which the band stop filtering unit is disposed;

a mobile communication antenna that is formed in an upward direction of the main board, and is formed in a P shape on one side of a dielectric board, on opposite upper surfaces of which the plurality of top loaders constituting the extended radiation unit of the broadcasting antenna are partly disposed; and a circularly polarized ceramic patch antenna that includes a patch antenna at a predetermined position on the main board on which the broadcasting antenna and the mobile communication antenna are located, and an extended ground that is formed of a metal conductor having the same shape as the patch antenna and is electrically connected with the ground plane.

2. The shark fin antenna apparatus according to claim 1, wherein the plurality of helical radiators formed in the first direction are formed in an upward direction of the main board; and the plurality of top loaders formed in the second direction are formed in a lengthwise direction of the main board.

3. The shark fin antenna apparatus according to claim 2, wherein the first and second directions join at an acute angle.

4. The shark fin antenna apparatus according to claim 3, wherein the at least one band stop filtering unit constituting each top loader provided to the extended radiation unit of the broadcasting antenna includes at least one band stop filter to remove interference signals of frequency bands at which the mobile communication antenna and the circularly polarized ceramic patch antenna operate, and an impedance matching element corresponding to the end of each helical radiator to which each top loader is electrically connected.

5. The shark fin antenna apparatus according to claim 4, wherein the plurality of conductive patterns constituting each top loader provided to the extended radiation unit of the broadcasting antenna are each formed at a shorter length than λ/8 of an operating frequency within a relatively highest one of frequency bands at which the mobile communication antenna and the circularly polarized ceramic patch antenna operate.

6. The shark fin antenna apparatus according to claim 5, wherein the mobile communication antenna includes at least one second band stop filtering unit that removes interference signals occurring when the broadcasting antenna operates, and a plurality of conductive patterns between which the second band stop filtering unit is disposed.

7. The shark fin antenna apparatus according to claim 6, wherein the at least one second band stop filtering unit provided to the mobile communication antenna includes a high pass filter that passes only signals of a higher frequency band than the operating frequency band at which the broadcasting antenna operates.

8. The shark fin antenna apparatus according to claim 7, wherein the plurality of conductive patterns constituting each top loader provided to the mobile communication antenna are each formed at a shorter length than λ/8 of an operating frequency within a relatively high frequency band of the double frequency band at which the broadcasting antenna operates.

9. The shark fin antenna apparatus according to claim 1, wherein the circularly polarized ceramic patch antenna includes:

a patch antenna unit having a dielectric through which a first feeder hole is bored and which is formed of a ceramic, a patch radiator that is formed of a quadrilateral metal thin film, diagonally opposite corners of which are partly chamfered for circular polarization, and that is formed on the dielectric, a main ground through which a second feeder hole is bored at a position corresponding to the first feeder hole so as to be larger in diameter than the feeder hole and which is formed of a metal thin film placed under the dielectric, and a feeder pin that connects the patch radiator and the feeder circuit on the main board through the first and second feeder holes; and an extended ground, through which a third feeder hole is bored so as to correspond to the second feeder hole, which is formed under the patch antenna unit, which has a predetermined thickness, which is formed of a metal conductor having a shape which is the same as a shape of the patch antenna unit, and which is electrically connected to a ground plane formed on the main board.

10. The shark fin antenna apparatus according to claim 9, wherein the circularly polarized ceramic patch antenna is configured to adjust the thickness of the extended ground formed under the patch antenna to control radiation efficiency of a specific frequency band at which the patch radiator of the patch antenna unit operates.

11. The shark fin antenna apparatus according to claim 10, wherein the circularly polarized ceramic patch antenna is configured to adjust the thickness of the extended ground to reduce a null point so as to increase an antenna gain thereof up to 1 dB or more.

12. The shark fin antenna apparatus according to claim 11, wherein the thickness of the extended ground is formed to be between 0.03λ and 0.2λ of an operating frequency such that directivity of a radiation pattern, which is formed in a direction parallel to the ground plane because of a field effect generated between the patch radiator of the patch antenna unit and the ground plane formed on the main board, is improved.

* * * * *